US008177209B2

(12) United States Patent
Chen

(10) Patent No.: US 8,177,209 B2
(45) Date of Patent: May 15, 2012

(54) VISE WITH SELF-SETTING LOCKING ASSEMBLY HAVING A SPRING ACTUATED SLIDE MEMBER FOR ENGAGING A SLIDE BAR

(75) Inventor: Wei-Li Chen, Taichung (TW)

(73) Assignee: Lai Lien Steel Co., Ltd., Taichung (TW)

( * ) Notice: Subject to any disclaimer, the term of this patent is extended or adjusted under 35 U.S.C. 154(b) by 140 days.

(21) Appl. No.: 12/832,075

(22) Filed: Jul. 8, 2010

(65) Prior Publication Data

US 2012/0007296 A1 Jan. 12, 2012

(51) Int. Cl.
*B25B 1/08* (2006.01)
*B25B 5/08* (2006.01)

(52) U.S. Cl. ..... 269/236; 269/6; 269/3; 269/43; 269/95; 269/228; 269/196; 269/249; 269/143

(58) Field of Classification Search ..... 254/253; 269/6, 43, 3, 95, 299, 217, 2, 5, 32, 24–27, 269/228–230, 234–236, 254 R, 254 CS, 166, 269/134, 138, 89, 93, 165, 191, 196, 201, 269/204, 215, 249, 143; 279/22, 30, 61, 279/58, 28, 75
See application file for complete search history.

(56) References Cited

U.S. PATENT DOCUMENTS 669,605 A * 3/1901 Vernon ..... 269/157
1,025,722 A * 5/1912 Roberts ..... 24/706.8
1,753,924 A * 4/1930 Gordon ..... 269/157
1,910,121 A * 5/1933 Muntz ..... 403/333
2,061,217 A * 11/1936 Watcher ..... 269/170
2,838,266 A * 6/1958 Rees ..... 248/354.1
2,838,948 A * 6/1958 Lassy ..... 74/424.78
3,109,213 A * 11/1963 O'Sullivan ..... 403/32
3,163,904 A * 1/1965 Ziolkowski ..... 403/365
3,806,107 A * 4/1974 Pitzer et al. ..... 269/188
3,912,406 A * 10/1975 McGrath ..... 403/19
3,975,032 A * 8/1976 Bent et al. ..... 279/30
4,923,185 A * 5/1990 Fan ..... 269/181
5,002,264 A * 3/1991 Nimtz ..... 269/41
5,022,264 A * 6/1991 Stauber ..... 73/382 R
5,692,734 A * 12/1997 Aldredge, Sr. ..... 269/166
6,012,712 A * 1/2000 Bernstein ..... 269/43
7,530,556 B1 * 5/2009 Zheng ..... 269/6
7,819,388 B2 * 10/2010 McCallion ..... 254/29 A

* cited by examiner

*Primary Examiner* — Joseph J Hall
*Assistant Examiner* — Tyrone V Hall, Jr.

(57) ABSTRACT

A clamp includes a rear receptacle; a front fixed jaw carrier having an eccentric guide and a guide slot; an intermediate moveable jaw carrier; a handle having one end urged against the guide member and comprising a slide sleeve retained in one end of the guide slot in a standby position; a slide bar having one end fastened in the slide sleeve and the other end being spring-actuated in the receptacle, a portion of the slide bar passing the guide member and the moveable jaw carrier; and a locking assembly comprising a seat including a funnel shaped channel; a spring-actuated slide member threadedly fastened in the seat and including a funnel shaped member having two steel balls and a projection; and a release lever having one retained end and including a tunnel and a biasing member put on the projection and biased between the seat and the release lever.

3 Claims, 13 Drawing Sheets

10-10

VISE WITH SELF-SETTING LOCKING ASSEMBLY HAVING A SPRING ACTUATED SLIDE MEMBER FOR ENGAGING A SLIDE BAR

BACKGROUND OF THE INVENTION

1. Field of Invention

The invention relates to tools and more particularly to a clamping tool with improved characteristics.

2. Description of Related Art

Clamping tools such as clamps, vises, etc. are well known. There is a type of clamp clip commercially available. However, a number of drawbacks have been found such type of tool. For example, there are a great number of components. The assembly is cumbersome and this in turn adversely affects mass production of such items. They are not robust and not reliable. Thus, the need for improvement still exists.

SUMMARY OF THE INVENTION

It is therefore one object of the invention to provide a clamp comprising a support comprising a rear receptacle; a front fixed jaw carrier disposed on the support and comprising an eccentric guide member, a first jaw, and a guide slot; an intermediate moveable jaw carrier disposed on the support and comprising a second jaw; a forward handle having one end matingly urged against the guide member and comprising a slide sleeve slidably retained in one end of the guide slot in a standby position of the clamp or in the other end of the guide slot in an operating position of the clamp; a slide bar having one end fastened in the slide sleeve and the other end being spring-actuated and retained in the receptacle, a portion of the slide bar between both ends passing the guide member and the moveable jaw carrier; and a locking assembly disposed in the moveable jaw carrier between the second jaw and the receptacle, the locking assembly comprising a hollow seat including a funnel shaped channel; a spring-actuated hollow slide member threadedly fastened in the seat and including a funnel shaped member having two opposite through holes and a projection projecting out of the channel; two steel balls rotatably disposed in the through holes; and a release lever having one end retained in bottom of the moveable jaw carrier, the release lever including a tunnel and a biasing member put on the projection and biased between the seat and the release lever, wherein the slide bar passes the tunnel and the slide member; wherein a portion of the release lever around the tunnel is in a tilted position relative to the slide bar and causes the slide bar to be locked by the tunnel; and wherein the steel balls are lockingly urged against both the channel and the slide bar in the standby position of the clamp.

The above and other objects, features and advantages of the invention will become apparent from the following detailed description taken with the accompanying drawings.

DETAILED DESCRIPTION OF THE INVENTION

Figure 1:
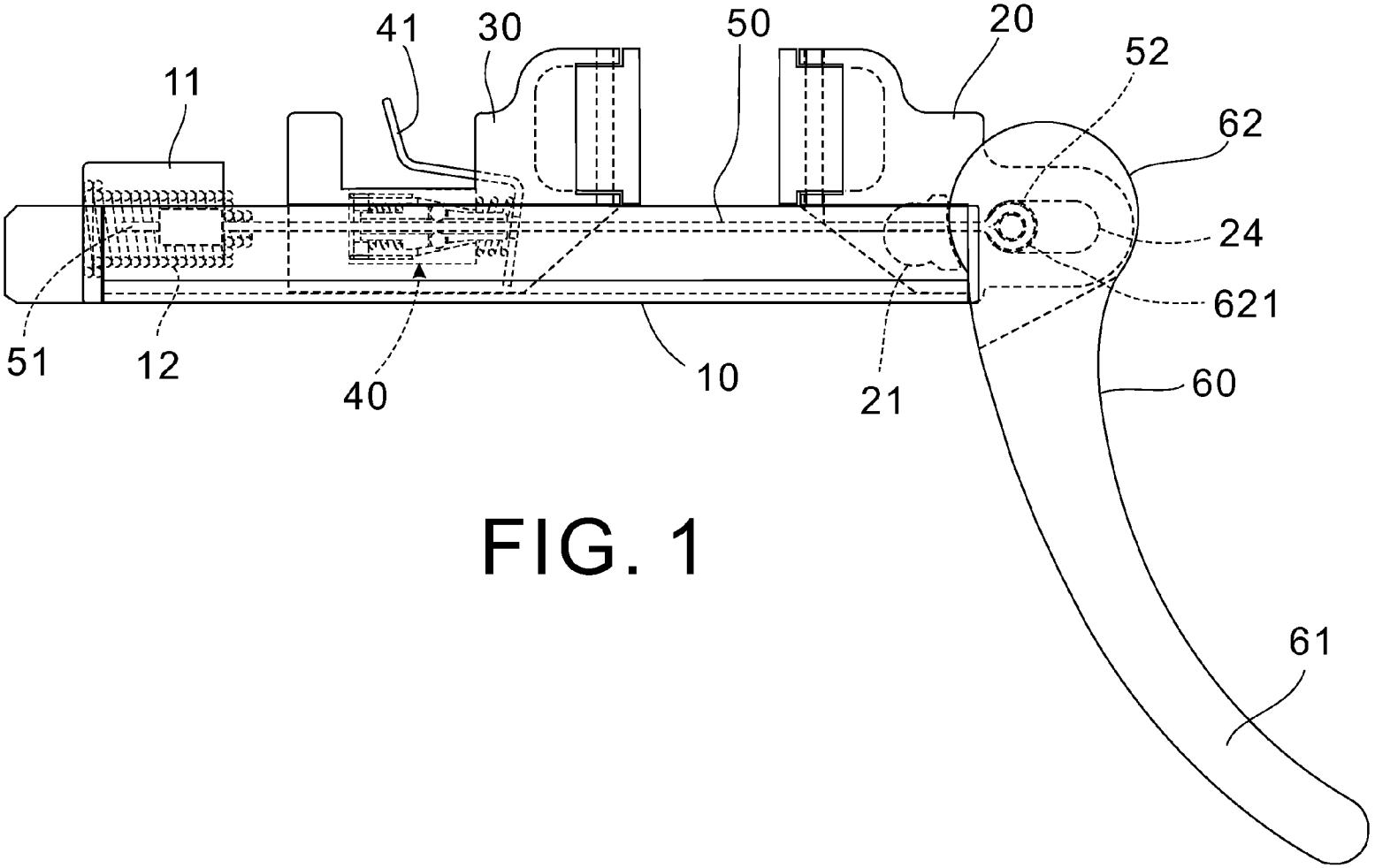
FIG. 1 is a side elevation of a clamping tool according to a first preferred embodiment of the invention.
Figure 2:
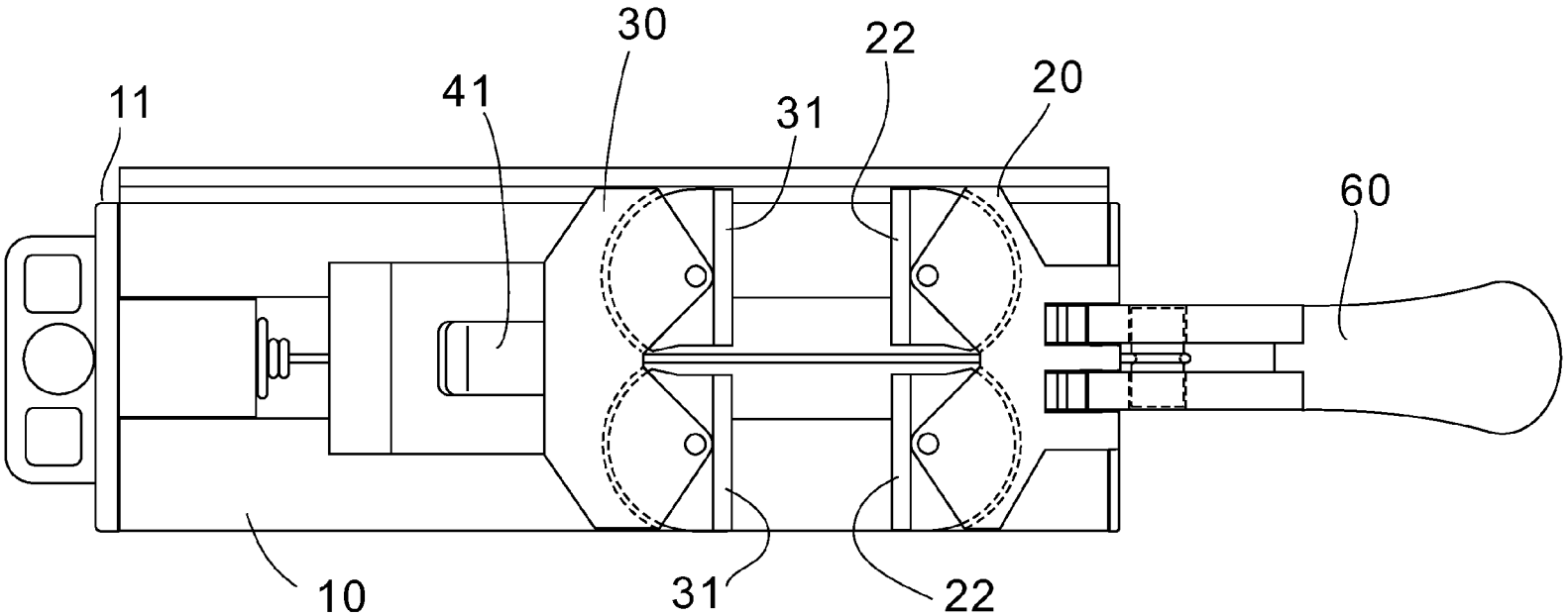
FIGS. 2 and 3 are top plan and front view of the clamping tool respectively.
Figure 3:
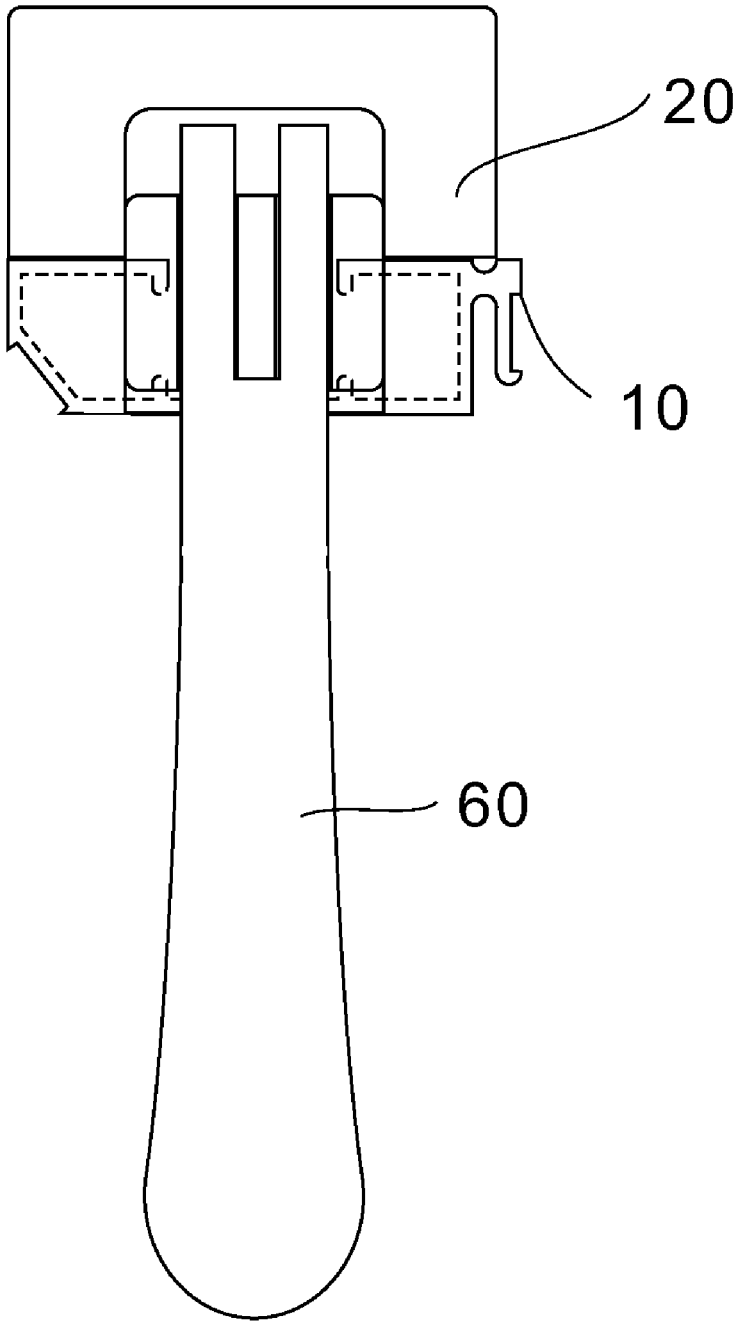
Figure 4:
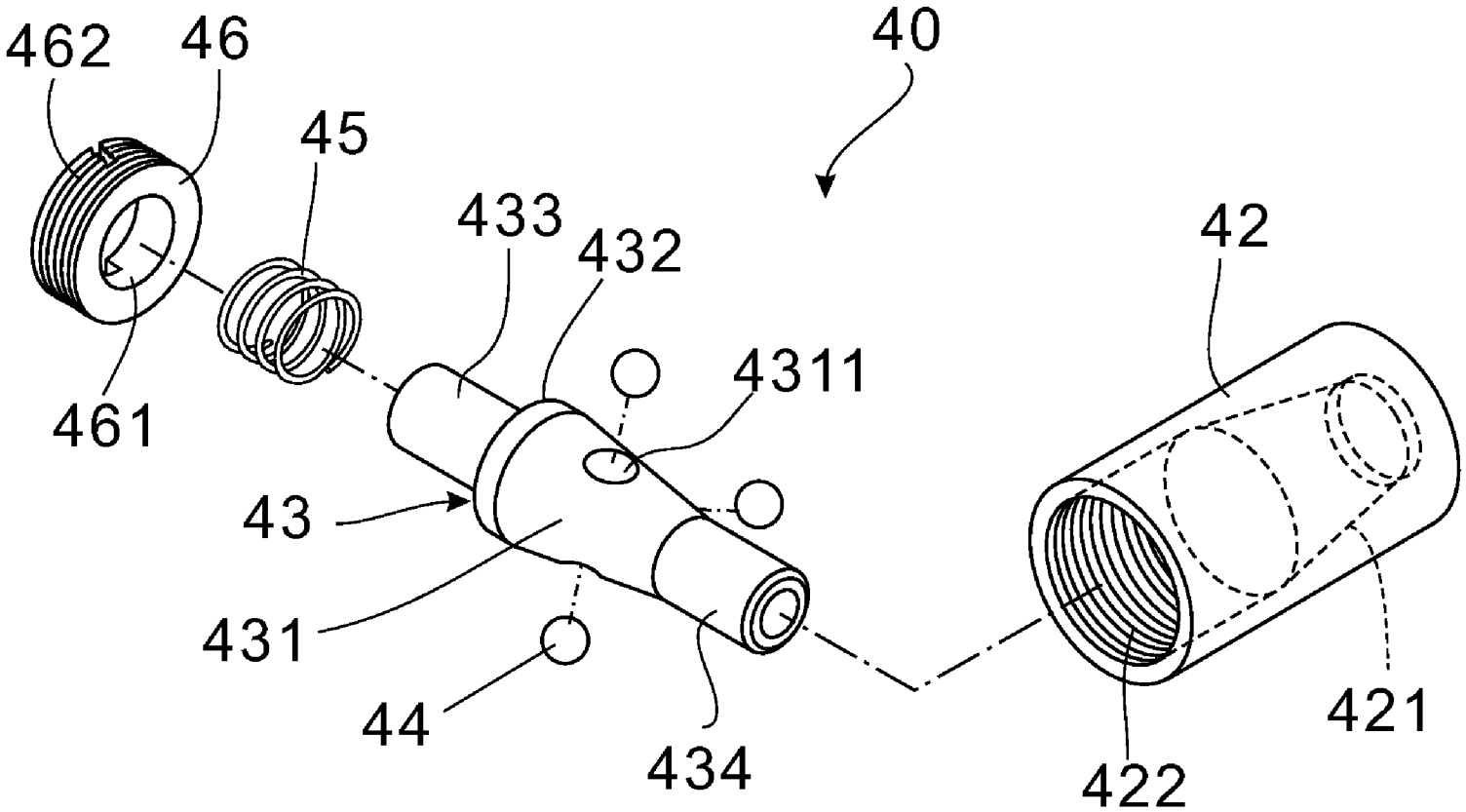
FIG. 4 is an exploded view of the locking assembly according to a first preferred configuration of the invention.

Referring to FIGS. 1 to 6, a clamping tool in accordance with the invention comprises the following components as discussed in detail below.

A rectangular support 10 comprises a rear receptacle 11 with a compression spring 12 anchored therein. A fixed jaw carrier 20 is provided on a front end of the support 10 and comprises an eccentric guide member 21 including a forward concave surface 212 and a rear convex surface 211 matingly engaged with a socket 23, two spaced pivotal jaws 22, and a front guide slot 24. An intermediate moveable jaw carrier 30 comprises two spaced pivotal jaws 31 facing the jaws 22.

An operational handle 60 comprises a manipulation portion 61 at one end and a joining portion 62 at the other end being matingly urged against the concave surface 212, the joining portion 62 having a slide sleeve 621 slidably retained in the guide slot 24. A slide bar 50 has a front end formed as a T 52 fastened in the slide sleeve 621, and an enlargement 511 proximate to a rear end 51 with the spring 12 biased thereon. The portion of the slide bar 50 from the T 52 to the rear end 51 passes the guide member 21, the socket 23, and the moveable jaw carrier 30.

A locking assembly 40 as a first preferred configuration of the invention is provided in the moveable jaw carrier 30 between the jaws 31 and a rear end of the moveable jaw carrier 30. The locking assembly 40 comprises a hollow cylindrical seat 42 fastened by the moveable jaw carrier 30 and including a funnel shaped forward channel 421 and a rear internal threaded section 422; a hollow slide member 43 including a rear cylindrical section 433 of reduced diameter, an intermediate funnel shaped member 431 having two opposite through holes 4311, a hollow, cylindrical projection 434 projecting out of the funnel shaped member 431, and a shoulder 432 between the rear cylindrical section 433 and the funnel shaped member 431; a compression spring 45 put on the rear cylindrical section 433 and engaged with the shoulder 432; two steel balls 44 rotatably disposed in the through holes 4311; and a ring shaped member 46 including an axial bore 461 and outer threads 462 secured to the internal threaded section 422 to urge the ring shaped member 46 against the spring 45. As a result, the slide member 43, the steel balls 44, the spring 45, and the ring shaped member 46 are assembled in the seat 42 with a substantial portion of the funnel shaped member 431 matingly disposed in the channel 421 and the projection 434 extending out of the channel 421.

The locking assembly 40 further comprises a release lever 41 having one end retained in a holed shaped member 301 on the bottom of the moveable jaw carrier 30 and the other end 413 exposed for manual manipulation. The release lever 41 further comprises a tunnel 412 with the slide bar 50 passing through, and a compression spring 411 put on the projection 434 and biased between a front end of the seat 42 and an internal locking portion of the release lever 41. The intermediate portion of the slide bar 50 passes the tunnel 412 and the slide member 43. Moreover, the spring 411 expands to dispose the locking portion of the release lever 41 in a slightly tilted position relative to the slide bar 50 and causes the slide bar 50 to be locked by the tunnel 412. This is the standby position of the clamping tool. It is noted that the steel balls 44 are lockingly urged against the inclined surface of the channel 421 and the slide bar 50.

Figure 6:
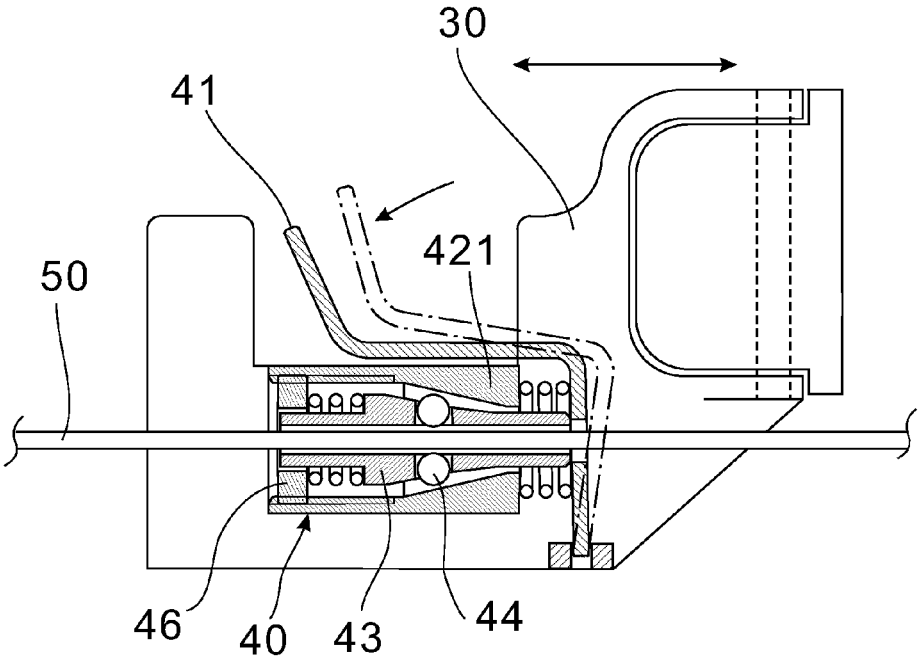
FIG. 6 is a fragmentary view of FIG. 5 showing an unlocking operation of the locking assembly and a movement of the moveable jaw carrier thereafter prior to either working on the work piece or loosening the work piece.

As shown in FIG. 6, in a clamping operation a person may place a work piece 90 in a space defined between the jaws 22 and 31. Next, pivot the release lever 41 counterclockwise with one hand to dispose the locking portion of the release lever 41 in a substantially perpendicular position relative to the slide bar 50 with the spring 411 compressed, the slide member 43 moving rearward, the spring 45 compressed, and the steel balls 44 disengaged from the inclined surface of the channel 421 and the slide bar 50. As such, the person may move the moveable jaw carrier 30 toward the fixed jaw carrier 20 until the work piece 90 is engaged between the jaws 22 and 31.

Figure 5:
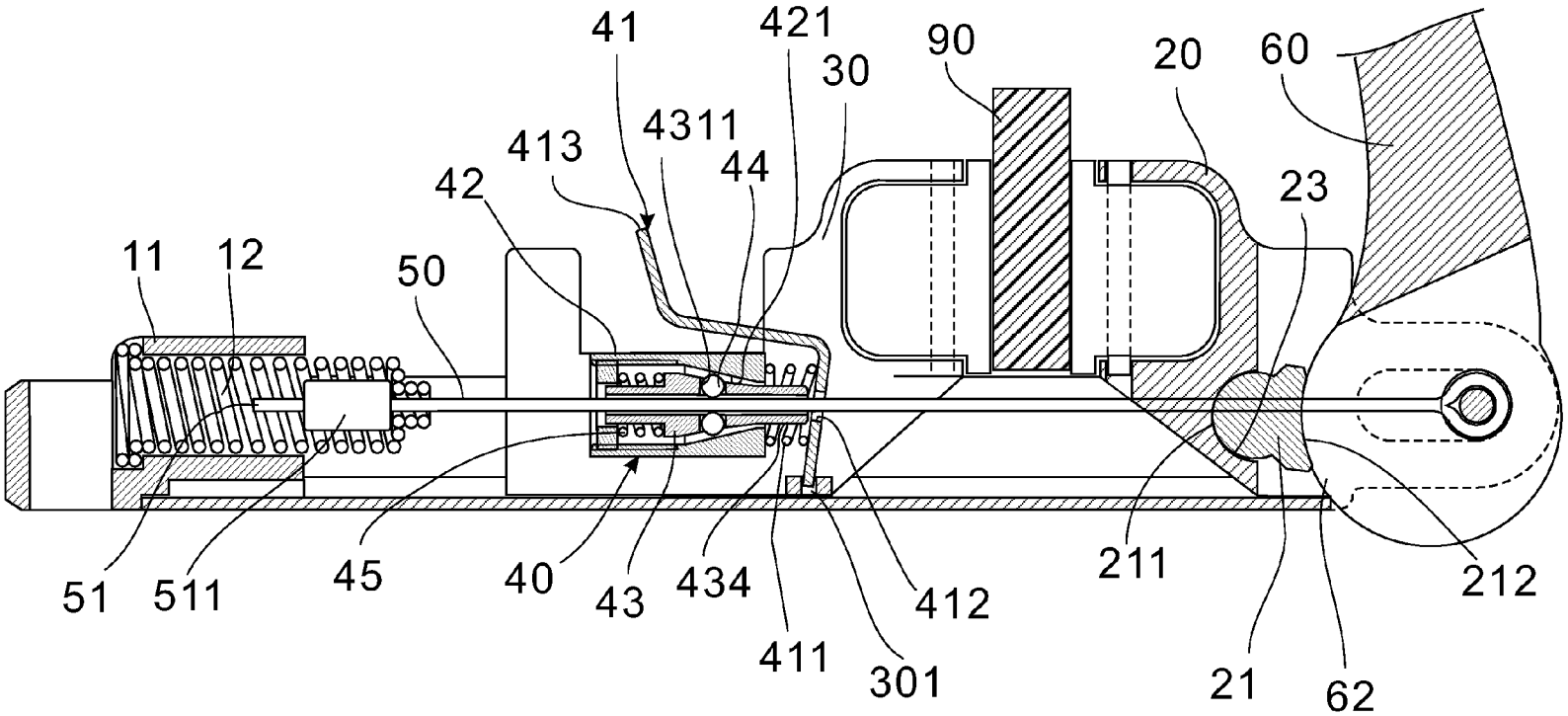
FIG. 5 is a view similar to FIG. 1 in part section showing a work piece being tightly held by the jaws to be worked on with the operational handle pivoted to depend upward.

Next, the person may pivot the operational handle 60 counterclockwise with the other hand (without releasing the release lever 41) to dispose the operational handle 60 from the position shown in FIG. 1 to that shown in FIG. 5 (i.e., about turning 180 degrees). As such, the slide sleeve 621 moves forward from one end of the guide slot 24 (see FIG. 1) to the other end thereof (see FIG. 5). Also, the T 52 (i.e., the enlargement 511) moves forward to expand the spring 12 and push both the moveable jaw carrier 30 and the locking assembly 40 forward until the work piece 90 is tightly held by the jaws 22 and 31. Thereafter, the person may release both the release lever 41 and the operational handle 60. As such, the locking portion of the release lever 41 is again in a slightly tilted position relative to the slide bar 50 and causes the slide bar 50 to be locked by the tunnel 412 due to the expansion of the spring 411. Moreover, the slide member 43 moves forward due to the expansion of the spring 45. And in turn, the steel balls 44 are lockingly urged against both the inclined surface of the channel 421 and the slide bar 50. Thereafter, the person may have both free hands to work on the work piece 90.

Again as shown in FIG. 6, if the clamped work piece 90 is to be loosened, the person may pivot the release lever 41 counterclockwise with one hand to dispose the locking portion of the release lever 41 in a substantially perpendicular position relative to the slide bar 50 with the spring 411 compressed, the slide member 43 moving rearward, the spring 45 compressed, and the steel balls 44 disengaged from the inclined surface of the channel 421 and the slide bar 50.

Next, the person may pivot the operational handle 60 clockwise with the other hand (without releasing the release lever 41) to dispose the operational handle 60 from the position shown in FIG. 5 to that shown in FIG. 1 (i.e., about turning 180 degrees). As such, the slide sleeve 621 moves rearward from the other end of the guide slot 24 (see FIG. 5) to one end thereof (see FIG. 1). Also, the T 52 (i.e., the enlargement 511) moves rearward due to the compression of the spring 12 and push both the moveable jaw carrier 30 and the locking assembly 40 rearward to loosen the work piece 90. Thereafter, the person may release both the release lever 41 and the operational handle 60. As such, the locking portion of the release lever 41 is again in a slightly tilted position relative to the slide bar 50 and causes the slide bar 50 to be locked by the tunnel 412 due to the expansion of the spring 411. Moreover, the slide member 43 moves forward due to the expansion of the spring 45. And in turn, the steel balls 44 are lockingly urged against both the inclined surface of the channel 421 and the slide bar 50. Thereafter, the person may have both free hands to remove the work piece 90.

Figure 7:
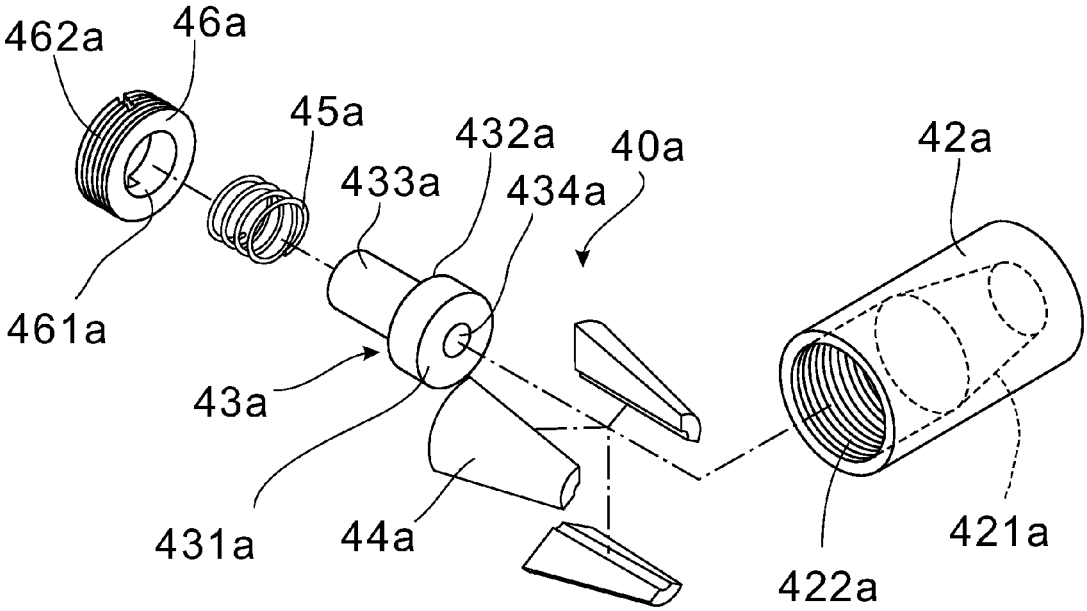
FIG. 7 is an exploded view of the locking assembly according to a second preferred configuration of the invention.
Figure 8:
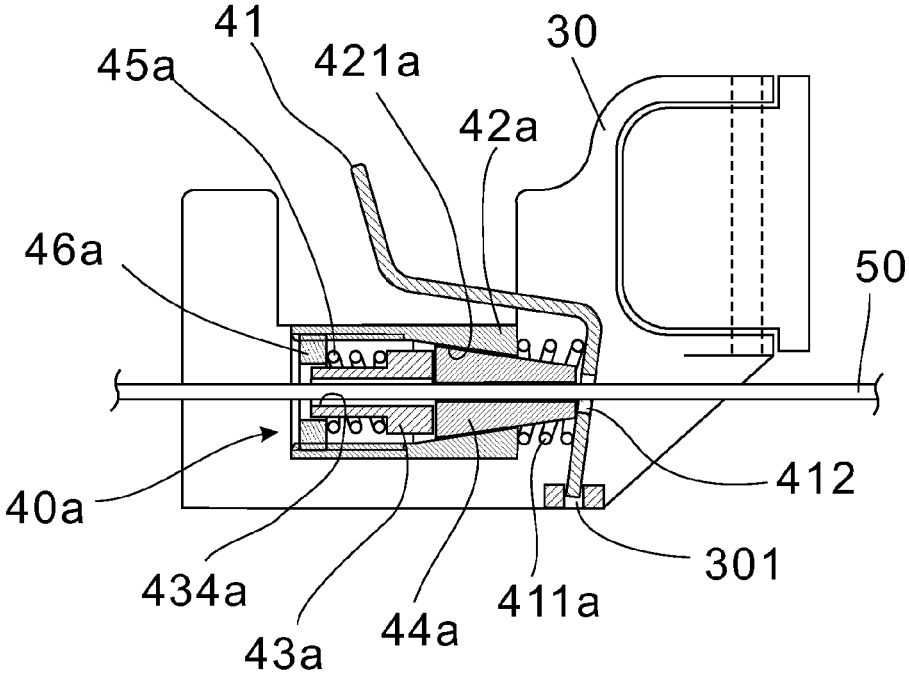
FIG. 8 is a view similar to FIG. 6 showing both the locking assembly and the moveable jaw carrier in a locked position.
Figure 10:
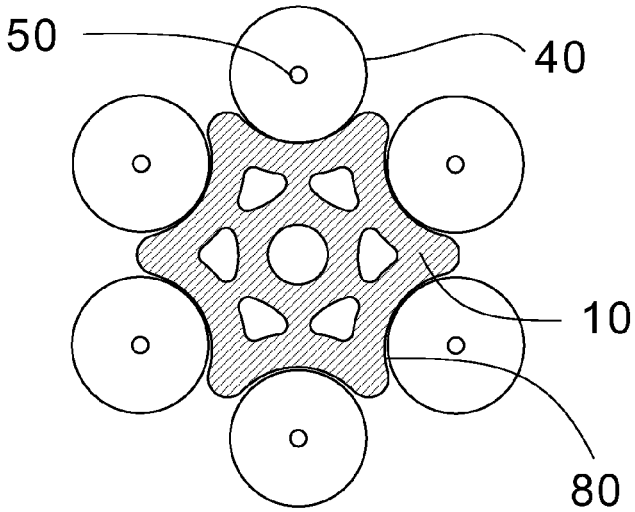
FIG. 10 is a sectional view taken along line 10-10 of FIG. 9.

Referring to FIGS. 7 and 8, a locking assembly 40*a* of a second preferred configuration of the invention is shown. The locking assembly 40*a* comprises a hollow cylindrical seat 42*a* fastened by the moveable jaw carrier 30 and including a funnel shaped forward channel 421*a* and a rear internal threaded section 422*a*; a hollow slide member 43*a* including a rear cylindrical section 433*a*, an enlargement section 431*a*, a shoulder 432*a* formed between the cylindrical section 433*a* and the enlargement section 431*a*, and an axial channel 434*a*; three block members 44*a* consisting of a funnel shaped member; a compression spring 45*a* put on the cylindrical section 433*a* and engaged with the shoulder 432*a*; and a ring shaped member 46*a* including an axial bore 461*a* and outer threads 462*a* secured to the internal threaded section 422*a* to urge the ring shaped member 46*a* against the spring 45*a*. As a result, the slide member 43*a*, the spring 45*a*, and the ring shaped member 46*a* are assembled in the seat 42*a* with a substantial portion of the block members 44*a* matingly disposed in the channel 421*a* and the remaining portion thereof extending out of the channel 421*a*.

The locking assembly 40*a* further comprises a release lever 41 having one end retained in a holed shaped member 301 on the bottom of the moveable jaw carrier 30 and the other end exposed for manual manipulation. The release lever 41 further comprises a tunnel 412 with the slide bar 50 passing through, and a compression spring 411*a* put on the extending portion of the block members 44*a* and biased between a front end of the seat 42*a* and an internal locking portion of the release lever 41. The intermediate portion of the slide bar 50 passes the tunnel 412, the block members 44*a*, and the slide member 43*a*. Moreover, the spring 411*a* expands to dispose the locking portion of the release lever 41 in a slightly tilted position relative to the slide bar 50 and causes the slide bar 50 to be locked by the tunnel 412. This is the standby position of the clamping tool. It is noted that the block members 44*a* are lockingly urged against the inclined surface of the channel 421*a* and the slide bar 50.

Referring to FIGS. 9 to 13, a clamping tool in accordance with a second preferred embodiment of the invention is shown and comprises the following components as discussed in detail below.

An elongated support 10 comprises a rear receptacle 11 with six compression springs 12 anchored therein, and six cavities 80 formed around its outer surface. A first moveable jaw (i.e., right jaw) 30 is provided on a front end of the support 10 and comprises a chamber 33. A slide bar 71 is disposed in the chamber 33 and has an end extending out of the chamber 33. A plate 70 is disposed in the chamber 33 and is fixedly secured to the slide bar 71. A compression spring 72 is put on the slide bar 71 and is biased between a wall of the chamber 33 and the plate 70. A moveable member 25 is slidably fastened between one end of the first jaw 30 and a pivotal operational handle 60. The exposed portion of the slide bar 71 passes the moveable member 25 to secure to the handle 60.

Each of six locking assemblies 40 is constructed the same as the locking assembly of the first preferred configuration of the invention. The locking assemblies 40 are mounted in an annular trough 32 of a second moveable jaw (i.e., left jaw) 30. The trough 32 has an inclined surface 321. The locking assemblies 40 are engaged with the cavities 80. One of six ropes 50 each has one end fastened at the plate 70 and the other end passing the first and second jaws 30 and the locking assembly 40 (i.e., the slide member 43) to secure to the spring 12.

In a clamping operation a person may place a work piece (not shown) in a space defined between the jaws 30. Next, pivot the release levers 41 counterclockwise to dispose the locking portion of each release lever 41 in a substantially perpendicular position relative to the rope 50 with the spring 411 compressed, the slide member 43 moving rearward, the spring 45 compressed, and the steel balls 44 disengaged from the inclined surface of the channel 421 and the rope 50. As such, the person may move the second jaw 30 toward the first jaw 30 or away from the first jaw 30 until the work piece is engaged between the jaws 30.

Figure 9:
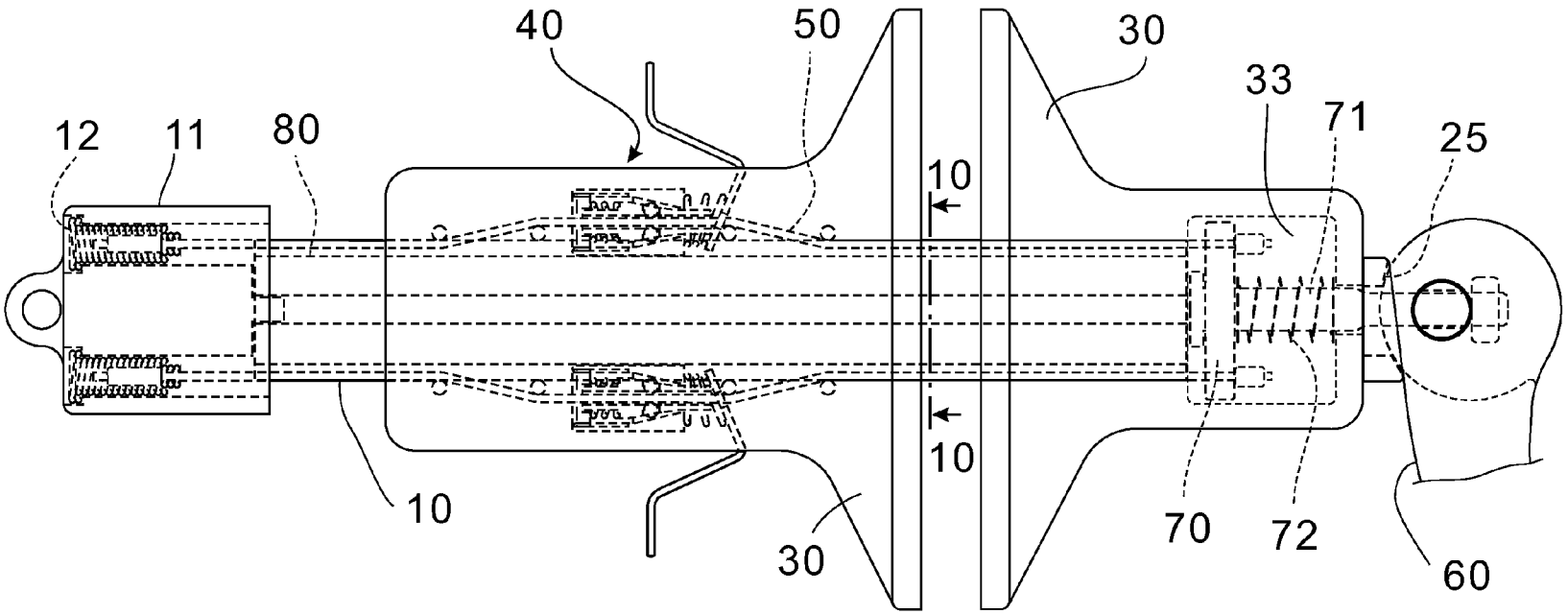
FIG. 9 is a side elevation of a clamping tool according to a second preferred embodiment of the invention.
Figure 11:
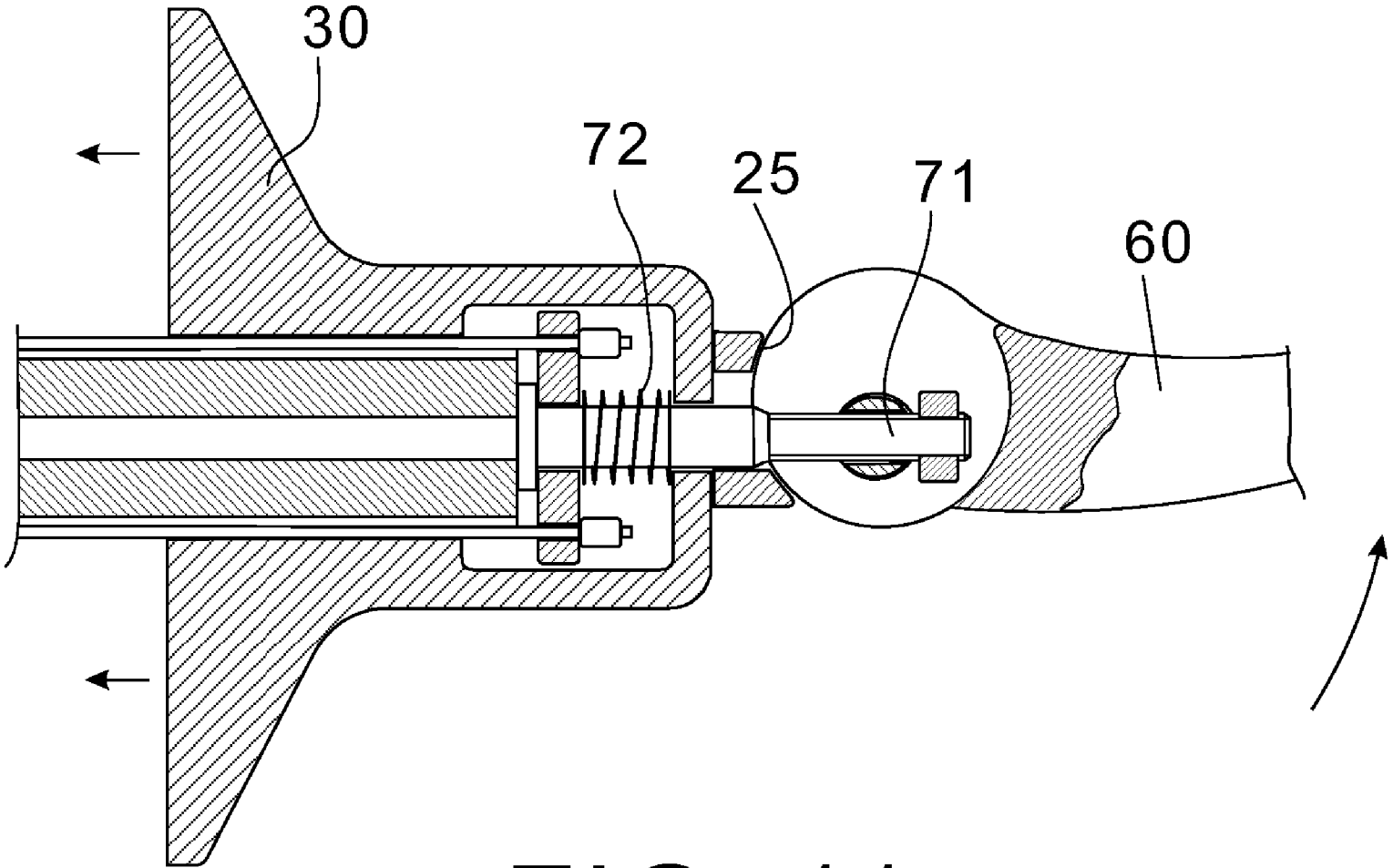
FIG. 11 is a sectional view of the right portion of FIG. 9 with the operational handle pivoted to a horizontal position for moving the right jaw.
Figure 12:
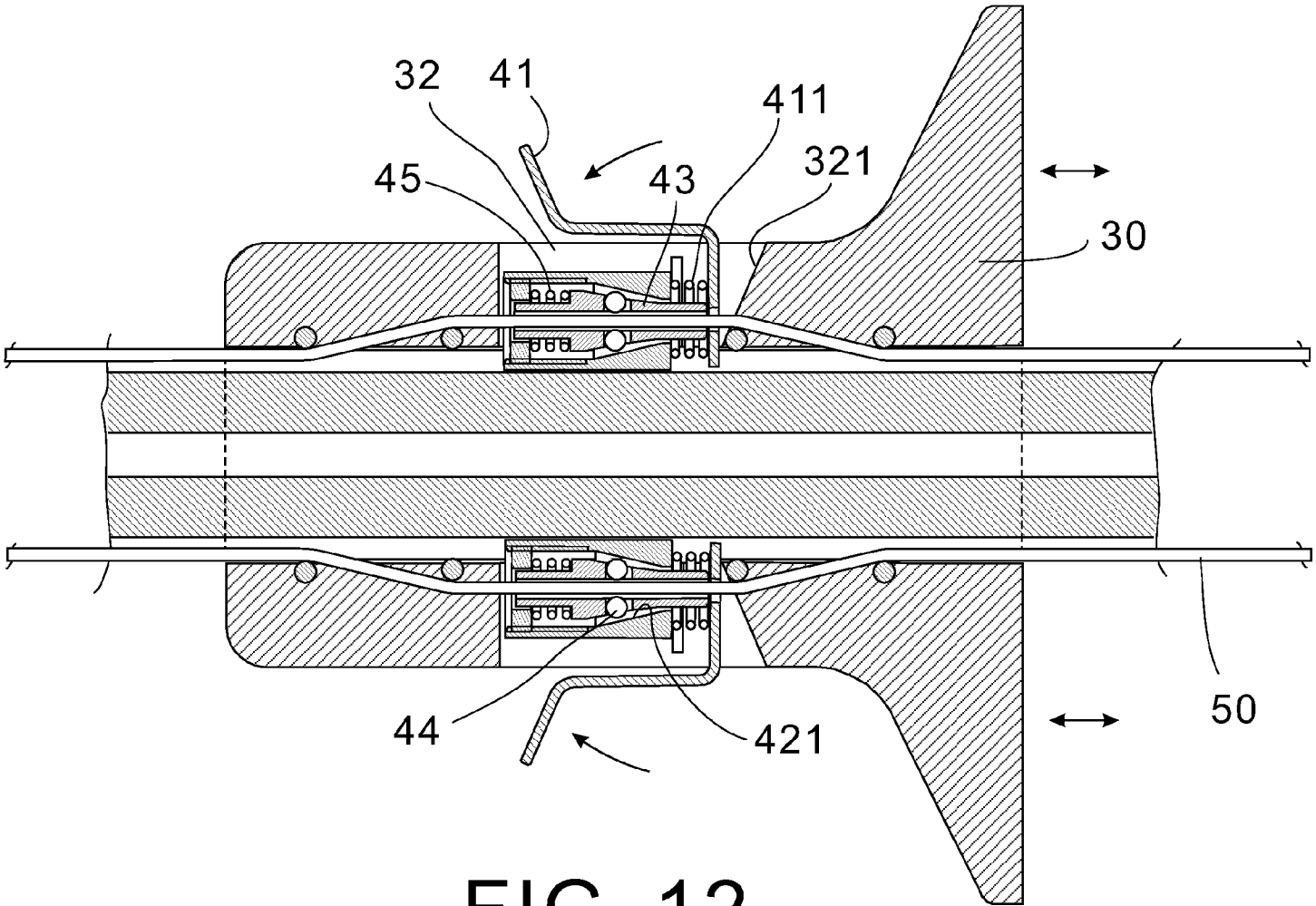
FIG. 12 is a sectional view of the intermediate portion of FIG. 9 with the left jaw being moved.
Figure 13:
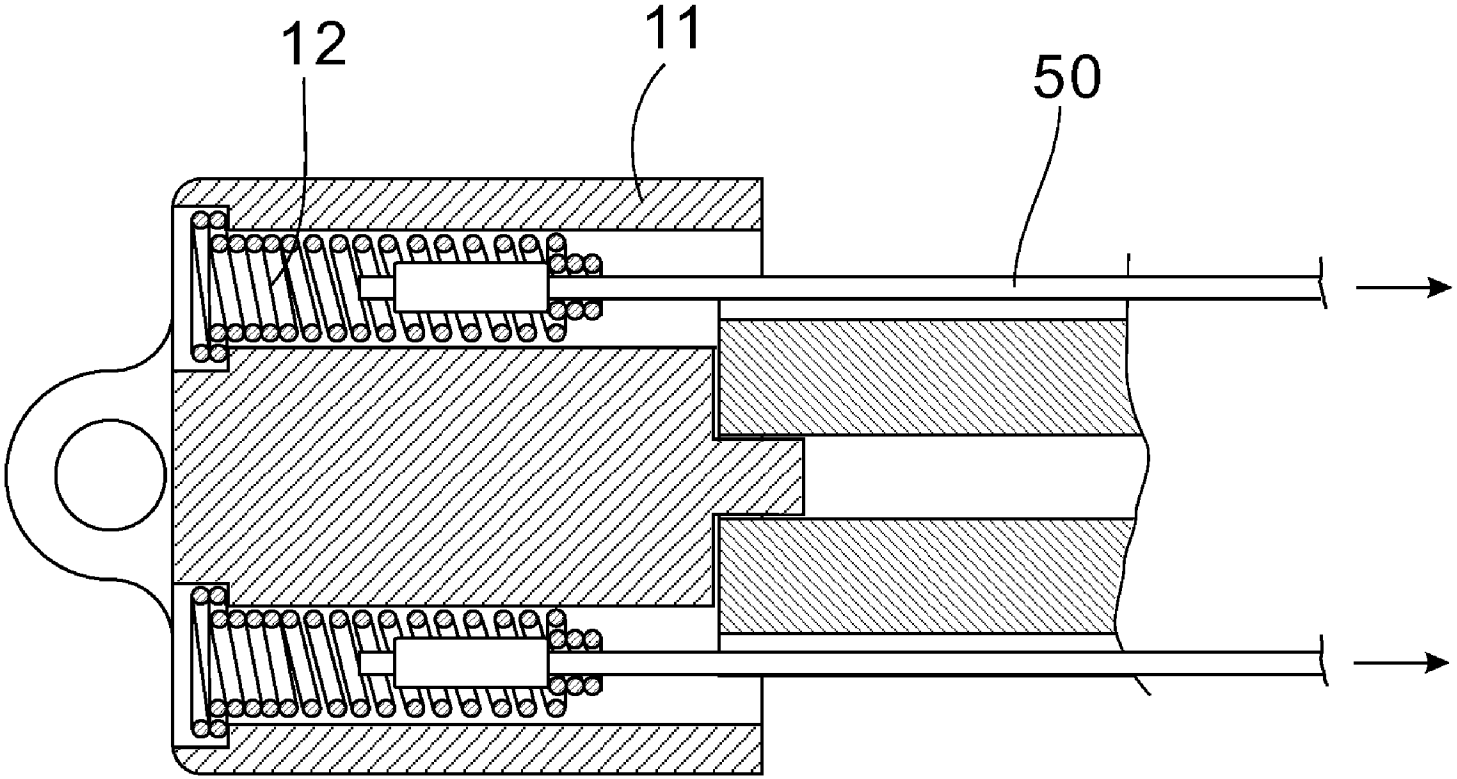
FIG. 13 a sectional view of the left portion of FIG. 9 with the ropes being pulled rightward.

Next, the person may pivot the operational handle 60 counterclockwise about 90 degrees with the release levers 41 being released to dispose the operational handle 60 from the position shown in FIG. 9 to that shown in FIG. 11. As such, the moveable member 25 moves upward to move the plate 70 rightward (i.e., forward) along the slide bar 71 with the spring 72 being compressed. Hence, the first jaw 30 moves leftward (i.e., rearward). As a result, the work piece is firmly held between the jaws 30. Thereafter, the person may have both free hands to work on the work piece.

A loosening operation of the work piece is a reverse traversal of steps described in the last two paragraphs and is thus deemed not necessary for the sake of brevity.

Referring to FIGS. 14 to 17, four different configurations of the supports 10 and the locking assemblies 40 are shown respectively.

Figure 14:
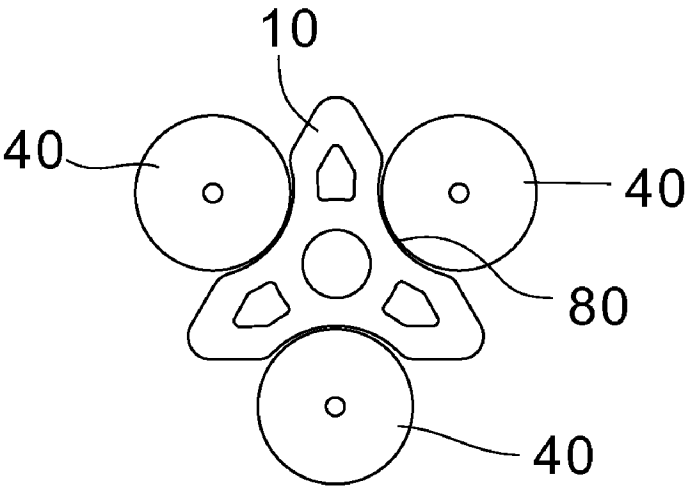
FIGS. 14 to 17 are views similar to FIG. 10 showing four different configurations of the supports and the locking assemblies respectively.

In FIG. 14, the support 10 is of a section of triangle and has a cavity 80 formed on each of three peripheral surfaces. Each of three locking assemblies 40 is urged against the cavity 80.

Figure 15:
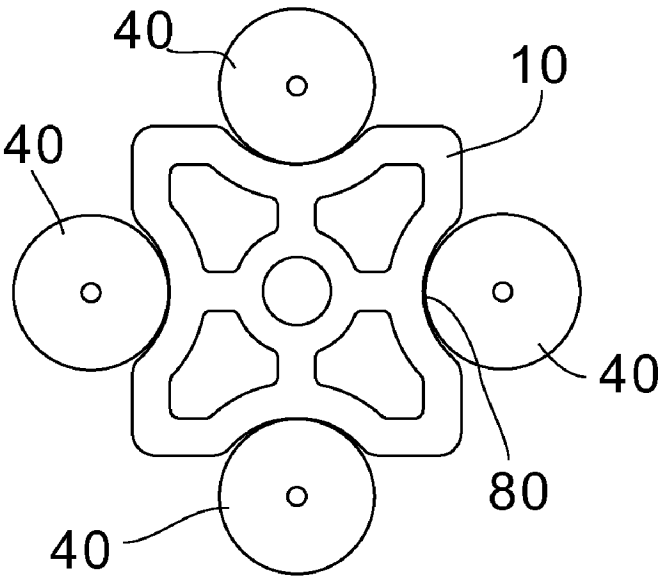

In FIG. 15, the support 10 is of a section of rectangle and has a cavity 80 formed on each of four peripheral surfaces. Each of four locking assemblies 40 is urged against the cavity 80.

Figure 16:
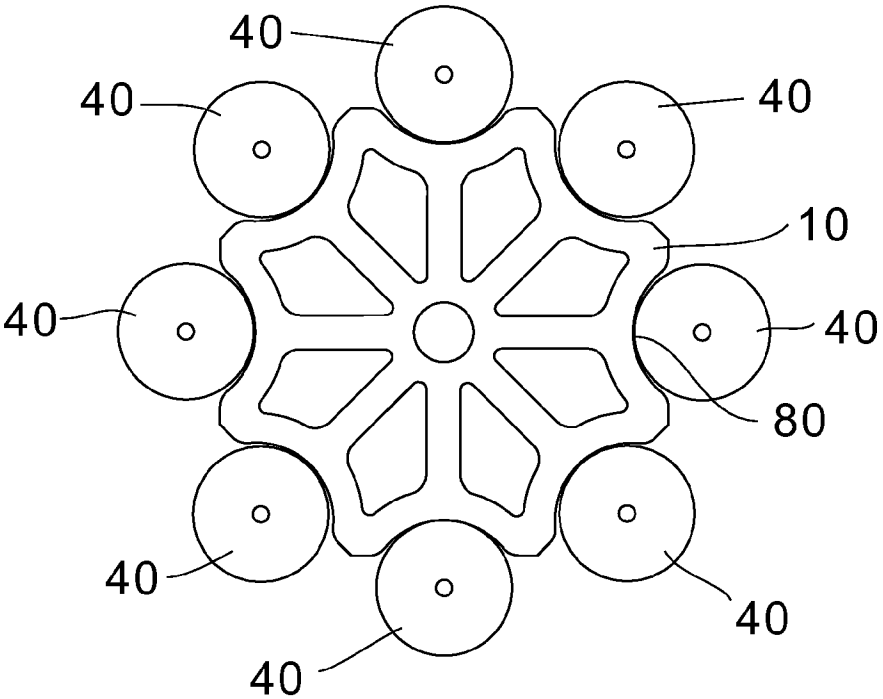

In FIG. 16, the support 10 is of a section of circle and has a cavity 80 formed on each of eight peripheral surfaces. Each of eight locking assemblies 40 is urged against the cavity 80.

Figure 17:
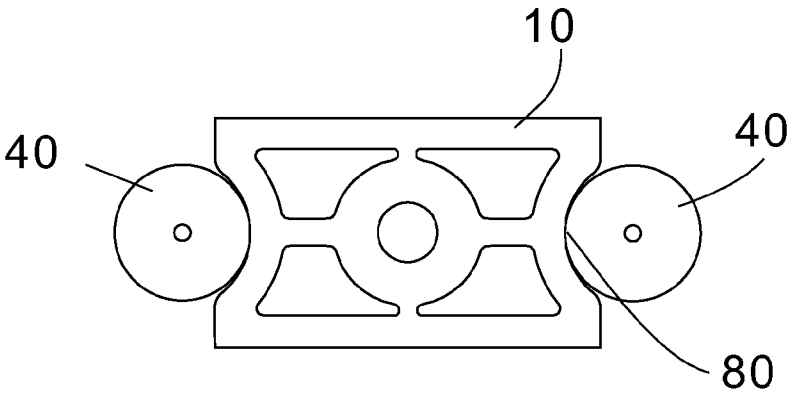

In FIG. 17, the support 10 is of a section of rectangle and has a cavity 80 formed on each of two side surfaces. Each of two locking assemblies 40 is urged against the cavity 80.

While the invention herein disclosed has been described by means of specific embodiments, numerous modifications and variations could be made thereto by those skilled in the art without departing from the scope and spirit of the invention set forth in the claims.

What is claimed is:

1. A clamp comprising:

a support comprising a rear receptacle;

a front fixed jaw carrier disposed on the support and comprising an eccentric guide member, a first jaw, and a guide slot;

an intermediate moveable jaw carrier disposed on the support and comprising a second jaw;

a forward pivotal handle having one end matingly urged against the guide member and comprising a slide sleeve slidably retained in one end of the guide slot in a standby position of the clamp or in the other end of the guide slot in an operating position of the clamp;

a slide bar having one end fastened in the slide sleeve and the other end being spring-actuated and retained in the receptacle, a portion of the slide bar between both ends passing through the guide member and the moveable jaw carrier; and a locking assembly disposed in the moveable jaw carrier between the second jaw and the receptacle, the locking assembly comprising a hollow seat including a funnel shaped channel; a spring-actuated hollow slide member threadedly fastened in the seat and including a funnel shaped member having two opposite through holes and a projection projecting out of the channel; two steel balls rotatably disposed in the through holes; and a release lever having one end retained in bottom of the moveable jaw carrier, the release lever including a tunnel and a biasing member put on the projection and biased between the seat and the release lever, wherein the slide bar passes through the tunnel and the slide member;

wherein a portion of the release lever around the tunnel is in a tilted position relative to the slide bar and causes the slide bar to be locked by the tunnel in the standby position of the clamp; and wherein the steel balls are lockingly urged against both the channel and the slide bar in the standby position of the clamp.

2. A clamp comprising:

a support comprising a rear receptacle;

a front fixed jaw carrier disposed on the support and comprising an eccentric guide member, a first jaw, and a guide slot;

an intermediate moveable jaw carrier disposed on the support and comprising a second jaw;

a forward pivotal handle having one end matingly urged against the guide member and comprising a slide sleeve slidably retained in one end of the guide slot in a standby position of the clamp or in the other end of the guide slot in an operating position of the clamp;

a slide bar having one end fastened in the slide sleeve and the other end being spring-actuated and retained in the receptacle, a portion of the slide bar between both ends passing through the guide member and the moveable jaw carrier; and a locking assembly disposed in the moveable jaw carrier between the second jaw and the receptacle, the locking assembly comprising a hollow seat including a funnel shaped channel; a spring-actuated hollow slide member threadedly fastened in the seat; a funnel member matingly disposed in the channel and being urged by the slide member, the funnel member having a projection projecting out of the channel; and a release lever having one end retained in bottom of the moveable jaw carrier, the release lever including a tunnel and a biasing member put on the projection and biased between the seat and the release lever, wherein the slide bar passes through the tunnel, the funnel member, and the slide member;

wherein a portion of the release lever around the tunnel is in a tilted position relative to the slide bar and causes the slide bar to be locked by the tunnel in the standby position of the clamp; and wherein the funnel member is lockingly urged against both the channel and the slide bar in the standby position of the clamp.

3. The clamp of claim 2, wherein the funnel member comprises three equal sections being put together.

* * * * *